US008042747B2

(12) United States Patent
Mospan et al.

(10) Patent No.: US 8,042,747 B2
(45) Date of Patent: Oct. 25, 2011

(54) NOTCHED TIE PLATE INSULATOR

(75) Inventors: John W. Mospan, Pittsburgh, PA (US); W. Thomas Urmson, Jr., Valencia, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 275 days.

(21) Appl. No.: 12/199,915

(22) Filed: Aug. 28, 2008

(65) Prior Publication Data

US 2009/0108086 A1 Apr. 30, 2009

Related U.S. Application Data

(60) Provisional application No. 60/966,956, filed on Aug. 31, 2007.

(51) Int. Cl.
*E01B 9/38* (2006.01)

(52) U.S. Cl. ..... 238/283; 238/287

(58) Field of Classification Search ..... 238/283, 238/382, 349, 351, 287, 293
See application file for complete search history.

(56) References Cited

U.S. PATENT DOCUMENTS

| | | | | | |
|---|---|---|---|---|---|
| 979,478 | A | | 12/1910 | Hall | |
| 1,750,735 | A | * | 3/1930 | Tupper | 238/283 |
| 1,792,620 | A | | 2/1931 | Wells | |
| 2,867,384 | A | | 1/1959 | Toulmin, Jr. | |
| 2,996,256 | A | | 8/1961 | Moses | |
| 3,080,120 | A | | 3/1963 | Turk | |
| 3,358,927 | A | * | 12/1967 | Hein et al. | 238/338 |
| 3,566,048 | A | | 2/1971 | Martin | |
| 4,047,663 | A | | 9/1977 | Reynolds et al. | |
| 4,618,093 | A | * | 10/1986 | Young et al. | 238/283 |
| 4,635,846 | A | * | 1/1987 | Todd | 238/264 |
| 4,971,247 | A | * | 11/1990 | Harkus | 238/283 |
| 5,203,502 | A | * | 4/1993 | Young | 238/283 |
| 5,549,245 | A | * | 8/1996 | Kish | 238/283 |
| 5,692,677 | A | * | 12/1997 | Duconseil | 238/283 |
| 5,730,357 | A | * | 3/1998 | Besenschek et al. | 238/283 |
| 5,782,406 | A | | 7/1998 | Igwemezie | |
| 6,045,052 | A | * | 4/2000 | Besenschek | 238/382 |
| 6,131,272 | A | | 10/2000 | Girouard, Sr. et al. | |
| 6,170,756 | B1 | | 1/2001 | Adkins et al. | |
| 6,179,215 | B1 | | 1/2001 | Shea | |

(Continued)

OTHER PUBLICATIONS

Web site pp. 1 and 2 for an Epoxy Fiberglass Insulated Rail Joints manufactured by Portec Rail Products, Inc., available at www.Portecrail.com, copyright 2001.

(Continued)

*Primary Examiner* — Joe Morano, IV
*Assistant Examiner* — Jason C Smith
(74) *Attorney, Agent, or Firm* — The Webb Law Firm

(57) ABSTRACT

A notched tie plate insulator adapted to be received within a recessed area of a tie plate of a railroad rail system. The insulator includes a bottom plate having a first side and a second side and a pair of side plates attached to the bottom plate. Each side of the bottom plate defines a notch therein. The side plate includes a longitudinal extending body having an upper surface and a lower surface and defining a recess on the upper surface and a protrusion on the lower surface, wherein the protrusion of each of the side plates is received within the notches of the bottom plate.

17 Claims, 10 Drawing Sheets

U.S. PATENT DOCUMENTS

| | | | | |
|---|---|---|---|---|
| 6,305,613 | B1 * | 10/2001 | Igwemezie | 238/287 |
| 6,305,614 | B1 | 10/2001 | Adkins et al. | |
| 6,308,897 | B1 | 10/2001 | Remington et al. | |
| 6,422,479 | B1 * | 7/2002 | Adkins et al. | 238/288 |
| 6,648,238 | B2 * | 11/2003 | Larke | 238/264 |
| 7,100,837 | B2 * | 9/2006 | Young | 238/382 |
| 7,374,109 | B2 * | 5/2008 | Ellerhorst | 238/283 |
| 7,717,352 | B2 * | 5/2010 | Loffelsend et al. | 238/382 |
| 2004/0155117 | A1 * | 8/2004 | Urmson et al. | 238/287 |
| 2006/0118649 | A1 * | 6/2006 | Urmson et al. | 238/287 |
| 2009/0108086 | A1 * | 4/2009 | Mospan et al. | 238/287 |
| 2009/0261177 | A1 * | 10/2009 | Hamilton et al. | 238/283 |

OTHER PUBLICATIONS

Web site pp. 1 and 2 for a Poly-Insulated Gauge Plate Insulator manufactured by Portec Rail Products, Inc., available at www.Poretcrail.com, copyright 2001.

* cited by examiner

NOTCHED TIE PLATE INSULATOR

CROSS REFERENCE TO RELATED APPLICATION

This application claims the benefit of U.S. Provisional Application No. 60/966,956, entitled "Notched Tie Plate Insulator", filed on Aug. 31, 2007, which is hereby incorporated by reference.

BACKGROUND OF THE INVENTION

1. Field of the Invention

The present invention relates to insulated tie plates and, more particularly, to a tie plate insulator for electrically isolating parts of a rail system from each other.

2. Description of Related Art

A rail system is generally divided into sections or blocks for detecting trains which permit more trains to travel on one stretch of track or railroad rails. Each section is electrically isolated from all other sections so that when no train is present, a high electrical resistance can be measured over the parallel railroad rails in that section. When a train enters the section, the train short circuits adjacent railroad rails and the electrical resistance drops, thus indicating that a train is in that section.

A tie plate, typically made of metal, is used to secure a railroad rail against lateral, rotational, and vertical movements. See, for example, U.S. Pat. No. 6,179,215. Railroad rails are generally joined to each other by welding each end or by attaching the ends using a steel rail joint. Generally, high performance, non-metallic rail joints are used for electrically isolating two railroad rails in order to build an electrically isolated section. However, when two separate railroad rail sections are joined using a typical metal tie plate, electrical isolation of the railroad rail sections will not occur because the current will pass from one railroad rail section through the tie plate and then to the adjacent railroad rail section. Non-metallic insulating tie plates are typically very expensive because of the special high-performance materials needed to endure the high tensile and flexural forces acting on the railroad rail. Also, prior art initially utilized unsupported joints, but due to insulated joints and to high rail traffic, the industry has switched to supported joints. However, the supported joints typically have been made of polyurethane, which cannot take the high rail traffic and fail prematurely.

It is, therefore, an object of the present invention to provide an insulated tie plate whereby the above drawbacks are eliminated.

SUMMARY OF THE INVENTION

The present invention provides for a notched tie plate insulator adapted to be received within a recessed area of a tie plate of a railroad rail system. The insulator includes a bottom plate having a first side and a second side and a pair of side plates attached to the bottom plate. Each side of the bottom plate defines a notch therein. The side plate includes a longitudinal extending body having an upper surface and a lower surface and defining a recess on the upper surface and a protrusion on the lower surface, wherein the protrusion of each of the side plates is received within the notches of the bottom plate.

The present invention can also be a tie plate assembly for a railroad rail that includes a tie plate having a recessed area adapted to receive a railroad rail, a layer of electrically-insulating material covering the recessed area of the tie plate, a plurality of slots defined on the tie plate and a fastener passing through one of the slots for securing the tie plate to a rail tie. The tie plate assembly can also include an electrically-insulated clip secured to the tie plate via the fastener, wherein the clip has a surface for coacting with a portion of the layer of electrically-insulating material such that lateral movement of the clip is limited when securing a railroad rail to the tie plate.

DESCRIPTION OF THE PREFERRED EMBODIMENTS

Figure 1:
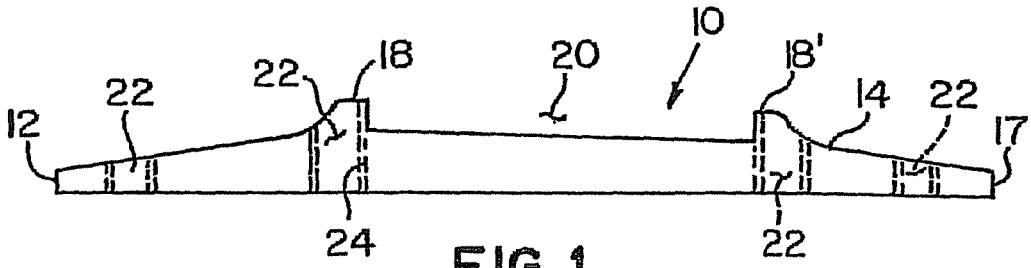
FIG. 1 is a side elevational view of a tie plate made in accordance with a first embodiment of the present invention.

The present invention prevents current from passing from one electrically-insulated railroad rail section through a tie plate to another railroad rail section by providing an electrically-insulated tie plate 10 whereby electric current cannot pass through.

FIGS. 1-4 show the tie plate 10 made in accordance with the present invention that includes a base plate 12 having a first surface 14 and a second surface 16 and defining a peripheral edge 17. A pair of longitudinally-extending shoulder members 18, 18' are defined on the first surface 14 of the base plate 12 and can extend a width W of the base plate 12 (shown in FIGS. 2 and 4). The second surface 16 of the base plate 12 is generally flat. A recessed area 20 is defined between each shoulder member 18, 18' on the first surface 14 of the base plate 12 and is used to accommodate a railroad rail 56 therebetween (shown in FIG. 8). Also, a plurality of slots 22 having an inner surface 24 are defined on the base plate 12. The slots 22 are generally adapted to receive fasteners 60 for securing the base plate 12 to a rail tie 86 (shown in FIG. 9). The base plate 12 can be a metallic core made from material such as steel.

Figure 2:
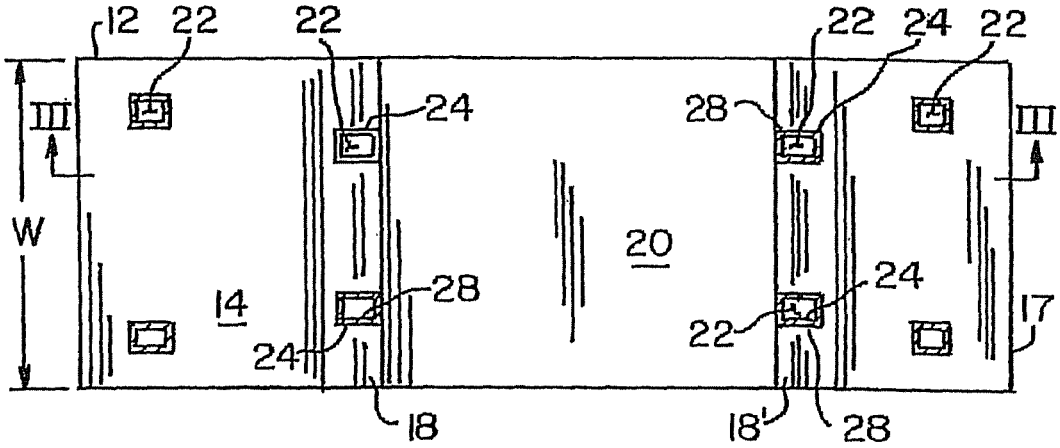
FIG. 2 is a top plan view of the tie plate shown in FIG. 1.
Figure 3:
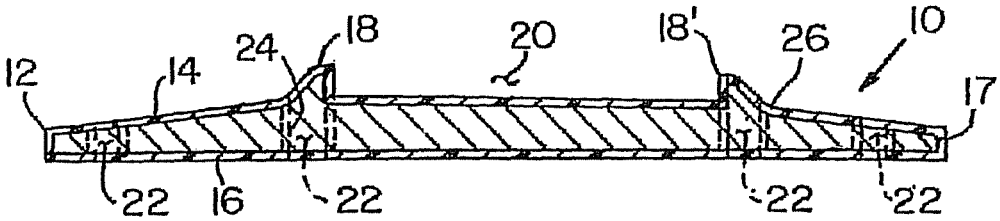
FIG. 3 is a sectional view taken along lines III-III shown in FIG. 2.
Figure 4:
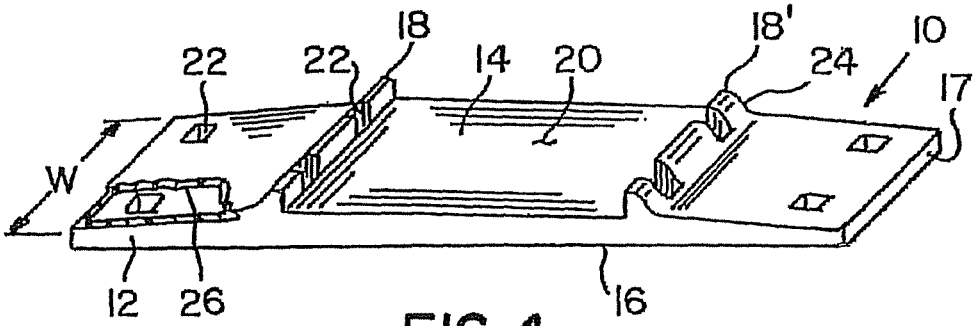
FIG. 4 is a perspective view, partially in section, of the tie plate shown in FIG. 1.
Figure 9:
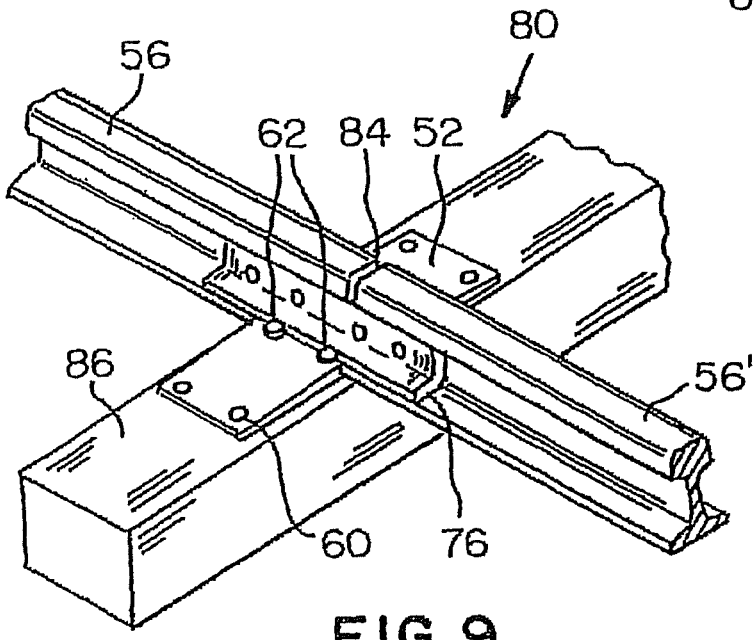
FIG. 9 is a perspective view, partially in section, of an electrically-isolated railroad rail system made in accordance with the present invention.
Figure 10:
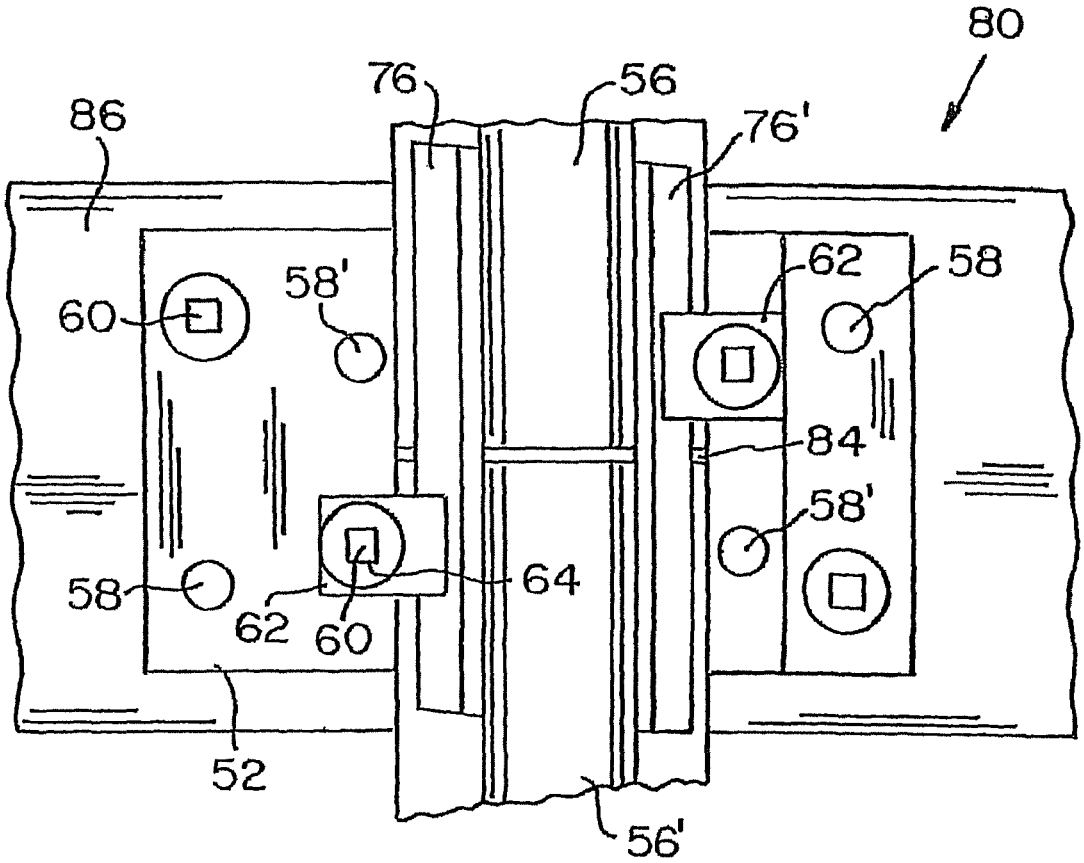
FIG. 10 is a top plan view of a tie plate assembly of the electrically-isolated railroad rail system shown in FIG. 9.

Referring to FIGS. 3 and 4, the tie plate 10 further includes a layer 26 of electrically-insulating material encapsulating the entire base plate 12, thus electrically insulating the tie plate 10. The layer 26 of electrically-insulating material can be a polymeric material, such as polyurethane, ultra high molecular weight polyethylene (UHMWPE), or rubber, a polymeric material containing reinforcing fibers, such as glass fibers, or also a laminated fiberglass may be used. The layer 26 can be molded onto the base plate 12 through any conventional method known in the art. The layer 26 for all embodiments disclosed in FIGS. 3-7 can also be extruded material such as the polymeric material, the polymeric material containing reinforcing fibers, and the laminated fiberglass as previously discussed, wherein the extruded material is adhered via an epoxy onto the base plate 12. The inner surface 24 of each slot 22 can also be covered by an inner layer 28 made of an electrically-insulating material as shown in FIG. 2. The inner layer 28 and the layer 26 can be made of the same electrically-insulating material. The inner layer 28 may be molded onto the inner surface 24 of each slot 22 or, alternatively, the inner layer 28 can be insertable into each of the slots 22, thus conforming to the shape of the inner surface 24 of the slot 22. The inner layer 28 prevents a fastener 60 from contacting the non-insulated inner surface 24 of the slot 22 in the base plate 12, thereby preventing electric current from passing through the fastener 60 and the base plate 12 to the railroad rail 56 (shown in FIG. 8). This is especially important where two separate railroad rails are attached to the same tie plate as shown in FIGS. 9 and 10.

Figure 5:
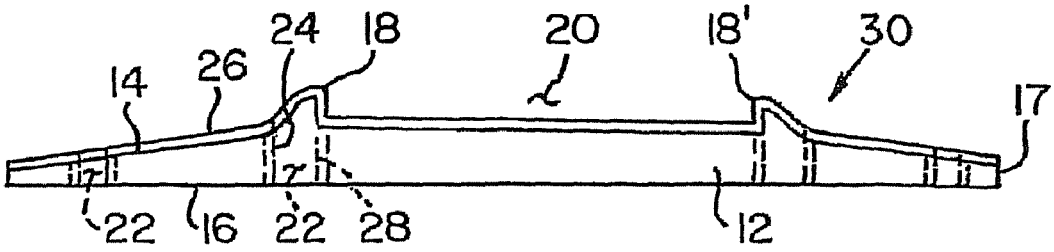
FIG. 5 is a side elevational view of a tie plate made in accordance with a second embodiment of the present invention.

FIG. 5 shows a second embodiment of a tie plate 30, which is similar to a tie plate 10 except for the below noted difference. Like reference numerals are used for like elements. In tie plate 30, only the first surface 14 of the base plate 12 is covered by a layer 26 of electrically-insulating material instead of the entire base plate 12 as in tie plate 10.

Figure 6:
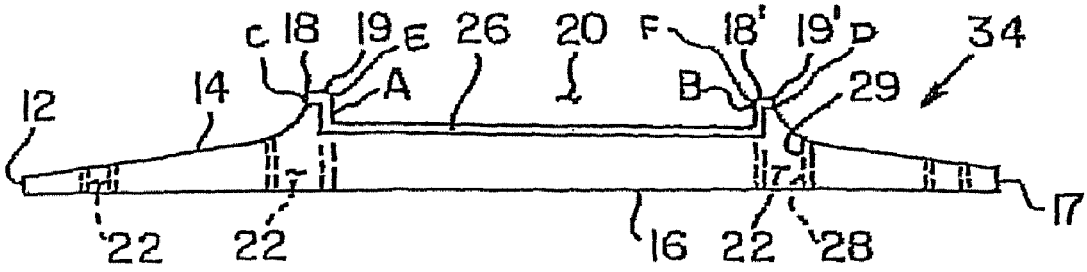
FIG. 6 is a side elevational view of a tie plate made in accordance with a third embodiment of the present invention.

FIG. 6 shows a third embodiment of a tie plate 34, which is similar to a tie plate 30 except for the below noted difference. Like reference numerals are used for like elements. In tie plate 34, only the recessed area 20 and the shoulder members 18, 18' on the first surface 14 of the base plate 12 are covered by a layer 26 of electrically-insulating material instead of the entire first surface 14 as in tie plate 30. Optionally, the layer 26 may not include lips 19 and 19' depending from legs A and B of the layer 26. Preferably, the layer 26 is made of UHMWPE or laminated fiberglass, but other insulating materials may be used.

Figure 7:
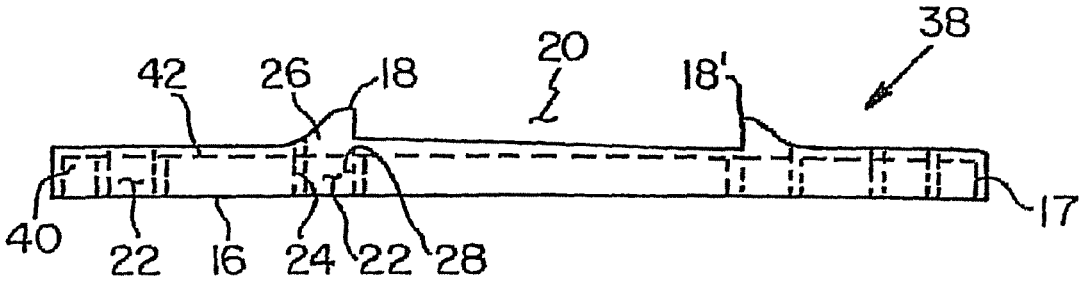
FIG. 7 is a side elevational view of a tie plate made in accordance with a fourth embodiment of the present invention.

FIG. 7 shows a fourth embodiment of a tie plate 38, which is similar to a tie plate 30 except for the below noted difference. Like reference numerals are used for like elements. Tie plate 38 includes a rectangular-shaped base plate 40 having a planar first surface 42. The layer 26 of electrically-insulating material also covers the first surface 42 and the peripheral edges 17 of the base plate 40. The overall shape of the tie plate 38 is similar to tie plates 10, 30, and 34 except that the pair of longitudinal-extending shoulder members 18, 18' are made of an electrically-insulating material.

Figure 8:
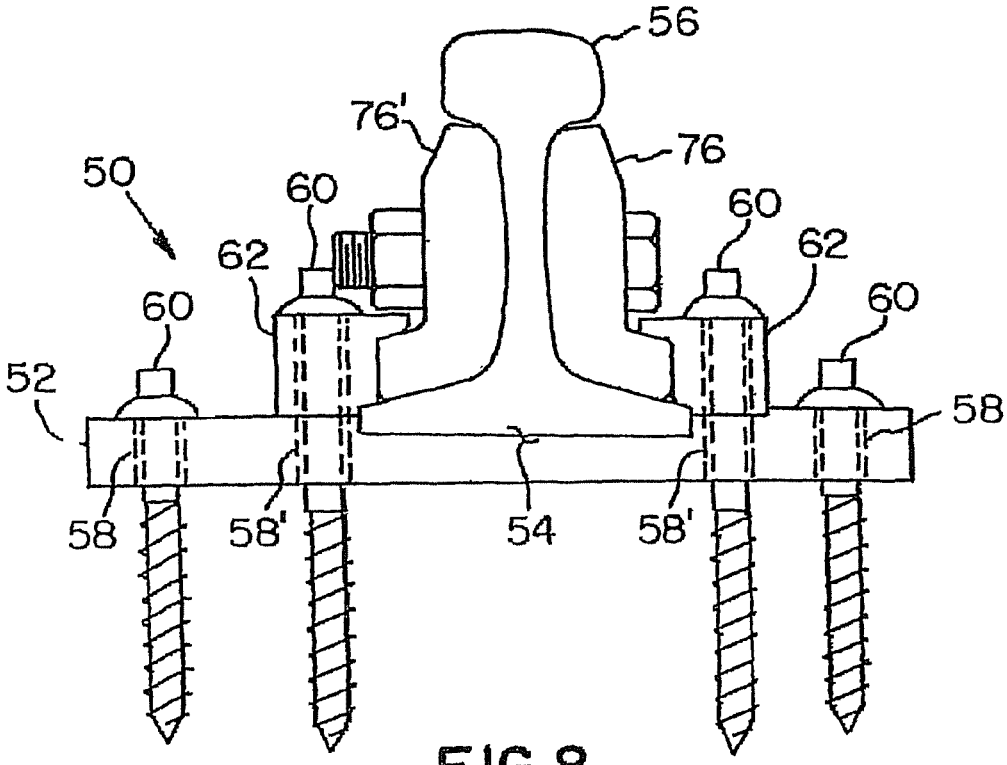
FIG. 8 is a side elevational view of a tie plate assembly made in accordance with the present invention.

FIG. 8 shows a tie plate assembly 50 for a railroad rail 56 made in accordance with the present invention, wherein like reference numerals are used for like elements. The tie plate assembly 50 includes an electrically-insulated tie plate 52 having a recessed area 54 adapted to receive the railroad rail 56, a plurality of slots 58, 58' defined on the tie plate 52, and at least one fastener 60 passing through one of the slots 58, 58' for securing railroad rail 56 to the tie plate 52. The tie plate 52 can be made of an electrically-insulated material, such as fiberglass. Also, the tie plate 52 can be made similar to tie plates 10, 30, 34, and 38 as previously discussed. Also, it is believed that the tie plate 52 can be extruded.

Figure 8A:
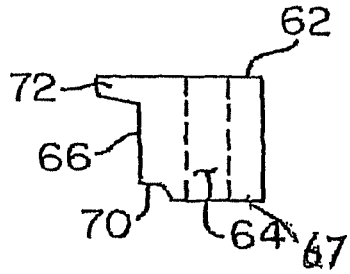
FIG. 8*a* is an elevational view of a clip of the tie plate assembly shown in FIG. 8.

Referring to FIGS. 8 and 8A, the tie plate assembly 50 also includes at least one electrically-insulated clip 62 defining a hole 64 for receiving the fastener 60. The clip 62 can be secured to the tie plate 52 via the fastener 60, wherein the clip 62 has a surface 66 that can coact with the railroad rail 56 or with a rail joint 76 attached to the railroad rail 56 for securing the railroad rail 56 to the tie plate 52. The surface 66 of the clip 62 defines a first ledge 70 on a bottom surface 67 thereof that adapts to coact with the railroad rail 56 for securing the railroad rail 56 to the tie plate 52. A second ledge 72 can also be defined on the surface 66 of the clip 62 and adapted to coact with the rail joint 76 attached to the railroad rail 56 in order to secure further the railroad rail 56 to the tie plate 52. The clip 62 can be made of fiberglass or of the same electrically-insulated material as tie plate 52. The clips 62 may be used in conjunction with the other tie plates disclosed herein and/or other types of insulating tie plates, such as, for example, the POLYPLATE® tie plate manufactured by Portec Rail Products, Inc.

FIGS. 9 and 10 show an electrically-isolated railroad rail system 80 made in accordance with the present invention, wherein like reference numerals are used for like elements. The railroad rail system 80 includes a pair of abutting railroad rails 56, 56' having a gasket 84 therebetween and at least one rail joint 76 attaching the railroad rails 56, 56' together. The gasket 84 is generally made of an electrically-insulated material, such as polyurethane, in order to prevent current from passing between the railroad rails 56, 56'. Typically, one rail joint 76 is attached to one side of the railroad rails 56, 56' and another rail joint 76' is attached to the opposite side of the railroad rails 56, 56'. The rail joints 76, 76' can be attached to each side of the railroad rails 56, 56' by welding or using mechanical fasteners. The rail joints 76, 76' are generally electrically-insulated in order to prevent current from passing between railroad rails 56, 56' via the rail joints 76, 76'. Such electrically-insulated rail joints 76, 76' are, for example, a Bonded Insulated Rail Joint™ and a POLYJOINT™ rail joint manufactured by Portec Rail Products, Inc.

With continued reference to FIGS. 9 and 10, the railroad rail system 80 also includes an electrically-insulated tie plate 52 having a recessed area 54 (shown in FIG. 8) and defining a plurality of slots 58, 58' as previously discussed. The tie plate 52 can be any of the electrically-insulated tie plates 10, 30, 34, and 38 as previously discussed. The attached railroad rails 56, 56' are received within the recessed area 54 of the tie plate 52. A fastener 60 passing through one of the slots 58 can be used to secure the tie plate 52 to a rail tie 86. The railroad rail system 80 can include a plurality of electrically-insulated clips 62, each defining a hole 64 as previously discussed. The clips 62, which have a surface 66 defining a first ledge 70 and a second ledge 72 (shown in FIG. 8A), can coact with railroad rails 56, 56' and the respective rail joint 76 or 76'. Referring to FIGS. 8 and 9, the first ledge 70 of the clip 62 abuts against a bottom surface of the railroad rail 56 or 56', and the second ledge 72 abuts against a bottom surface of the respective rail joint 76 or 76', wherein the fastener 60 passing through the hole 64 in the clip 62 and one of the slots 58' adjacent the railroad rails 56, 56' can be used to secure both the railroad rails 56, 56' to the tie plate 52 and the tie plate 52 to the rail tie 86.

In operation, an electrically-insulated tie plate 52 is placed on a rail tie 86. Next, a pair of abutting railroad rails 56, 56' having a gasket 84 therebetween are joined together via a pair of rail joints 76, 76', each attached to one side of the pair of abutting railroad rails 56, 56'. Third, the attached railroad rails 56, 56' are then received within a recessed area 54 of an electrically-insulated tie plate 52. Fourth, a hole 64 defined in an electrically-insulated clip 62 is aligned with a slot 58' adjacent the railroad rails 56, 56' in the tie plate 52 so that a surface 66 of the clip 62 contacts both the railroad rail 56 or 56' and the rail joint 76 or 76', respectively. Fifth, a fastener 60 is inserted through the hole 64 in the clip 62 and the slot 58' adjacent the railroad rails 56, 56' in the tie plate 52, wherein the surface 66 of the clip 62 coacts with the railroad rail 56 or 56' and the rail joint 76 or 76', respectively, thus securing the railroad rails 56, 56' to the tie plate 52 and the tie plate 52 to the rail tie 86. Finally, fasteners 60 are inserted through slots 58 in the tie plate 52, thus securing the tie plate 52 to the rail tie 86.

Figure 11:
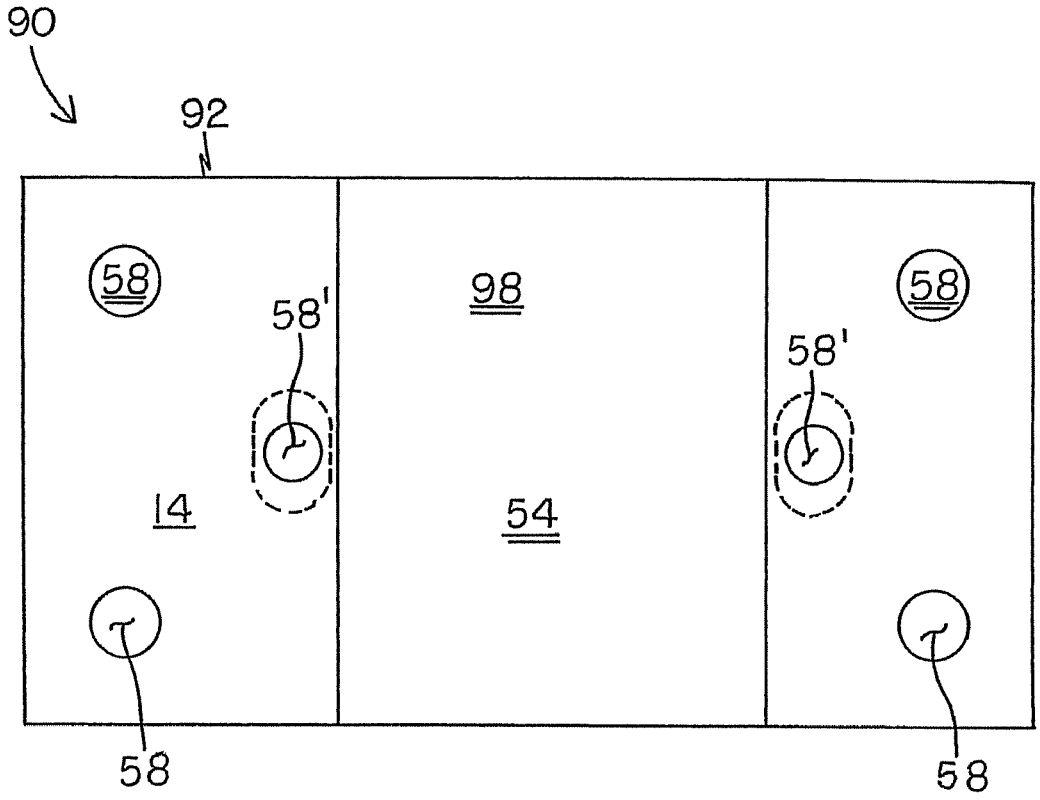
FIG. 11 is a top plan view of a tie plate made in accordance with a fifth embodiment of the present invention.
Figure 12:
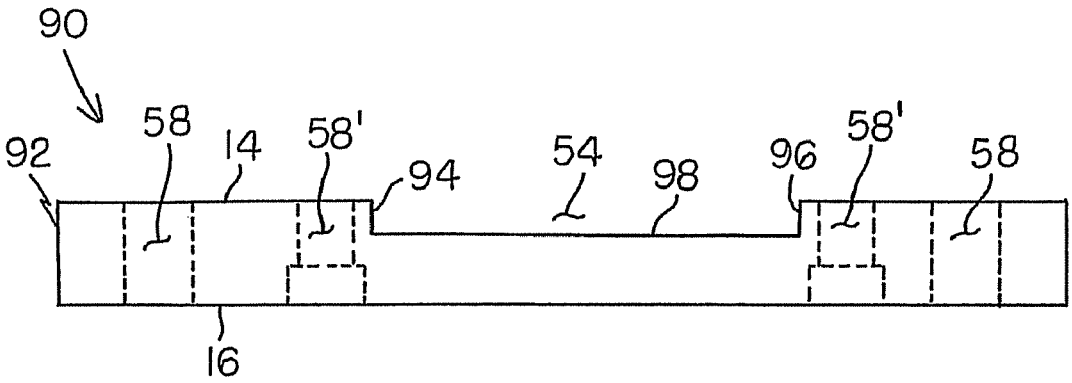
FIG. 12 is a side elevational view of the tie plate shown in FIG. 11.

FIGS. 11 and 12 show a fifth embodiment of a tie plate 90, which is similar to a tie plate 52 except for the below noted difference. Like reference numerals are used for like elements. The tie plate 90 having a first surface 14 and a second surface 16 includes a rectangular shaped body 92 defining a recessed area 54 therein adapted to receive a railroad rail. The recessed area 54 is defined by two spaced-apart sidewalls 94, 96 and a planar recess surface 98 therebetween. The first surface 14 and the second surface 16 of the body 92 is generally flat and includes a plurality of slots 58, 58' defined therein for receiving fasteners. Instead of the tie plate 90 being made of an electrically-insulated material as in tie plate 52, tie plate 90 can be made of metal such as steel. As previously discussed, a layer 26 of electrically-insulating material can cover either the entire tie plate, the entire first surface 14 of the body 92 or only the recessed area 54 of the body 92 for electrical isolation of a railroad rail system.

Figure 13:
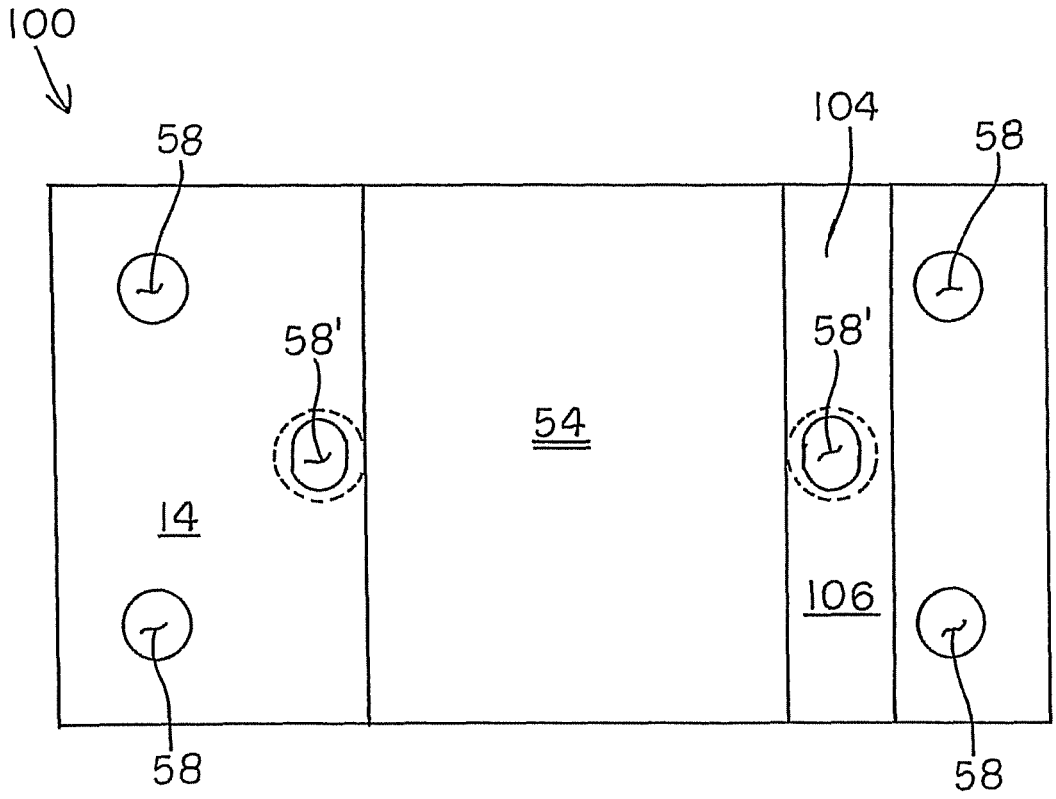
FIG. 13 is a top plan view of a tie plate made in accordance with a sixth embodiment of the present invention.
Figure 14:
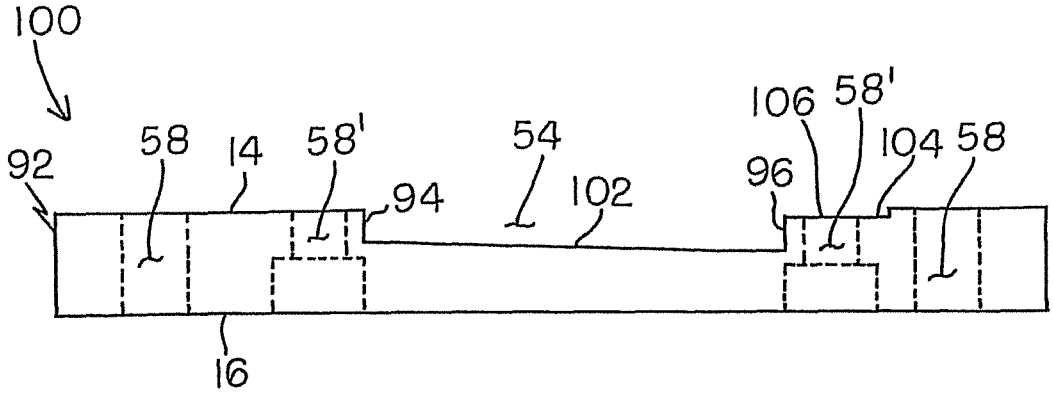
FIG. 14 is a side elevational view of the tie plate shown in FIG. 13.

FIGS. 13 and 14 show a sixth embodiment of a tie plate 100, which is similar to a tie plate 90 except for the differences noted below. Like reference numerals are used for like elements. Instead of a planar recess surface 98 of the recessed area 54 as in tie plate 90, tie plate 100 includes a sloped or tapered recess surface 102, wherein the recess surface 102 tapers toward the second surface 16 from a first sidewall 94 to a second sidewall 96. Because the height of the sidewalls 94, 96 are substantially the same, the first surface 14 of the body 92 includes a ledge or step 104 defined adjacent to the second sidewall 96. The ledge 104 has a surface 106 that extends at or slightly past the slot 58' such that the bottom surface 67 of a clip 62 (shown in FIGS. 8A and 15) abuts against the surface 106 of the ledge 104.

Figure 15:
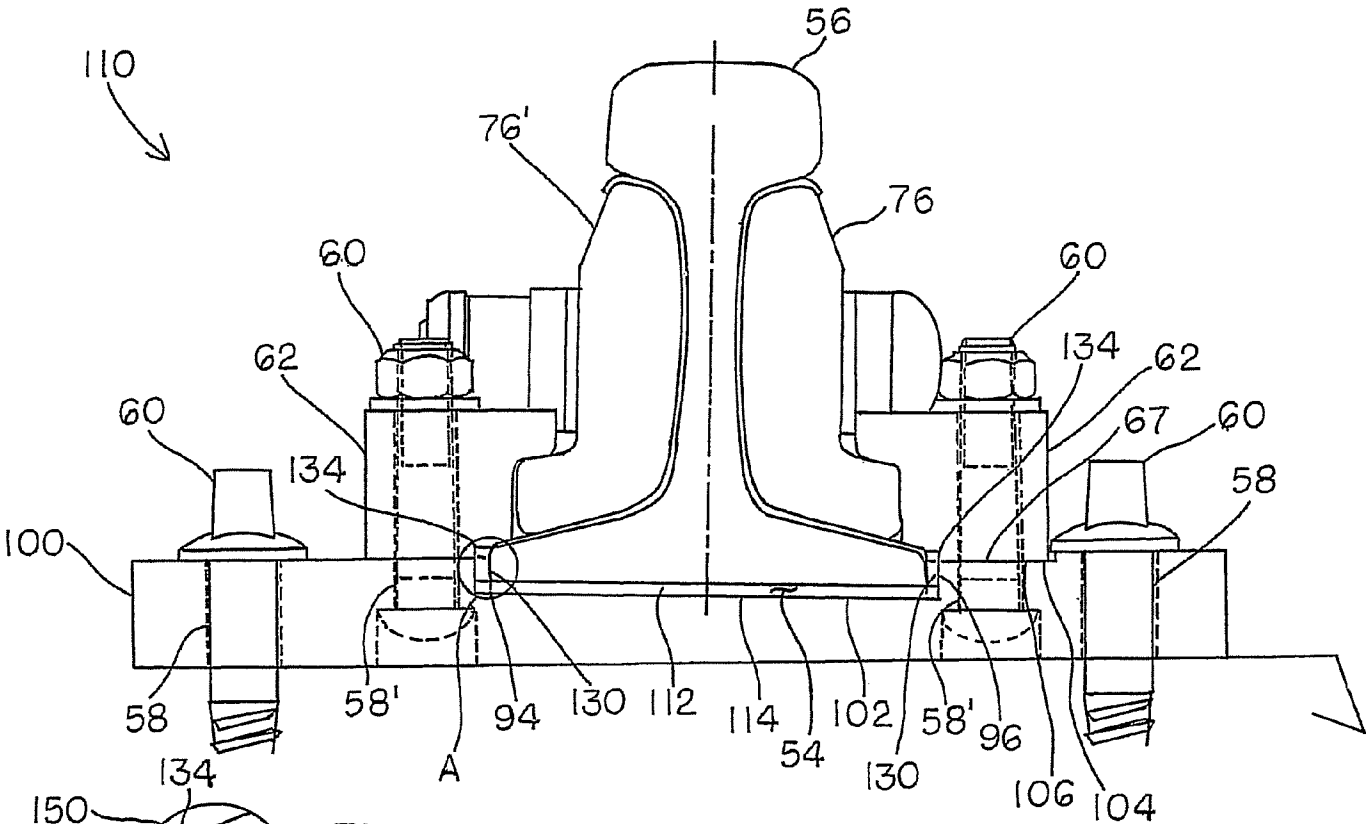
FIG. 15 is a side elevational view of a tie plate assembly made in accordance with a second embodiment of the present invention.
Figure 15A:
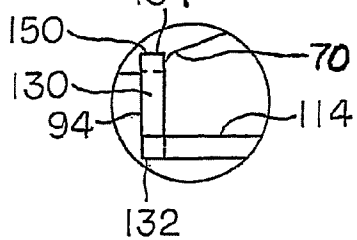
FIG. 15A is an exploded view of section A of the tie plate assembly shown in FIG. 15.
Figure 16:
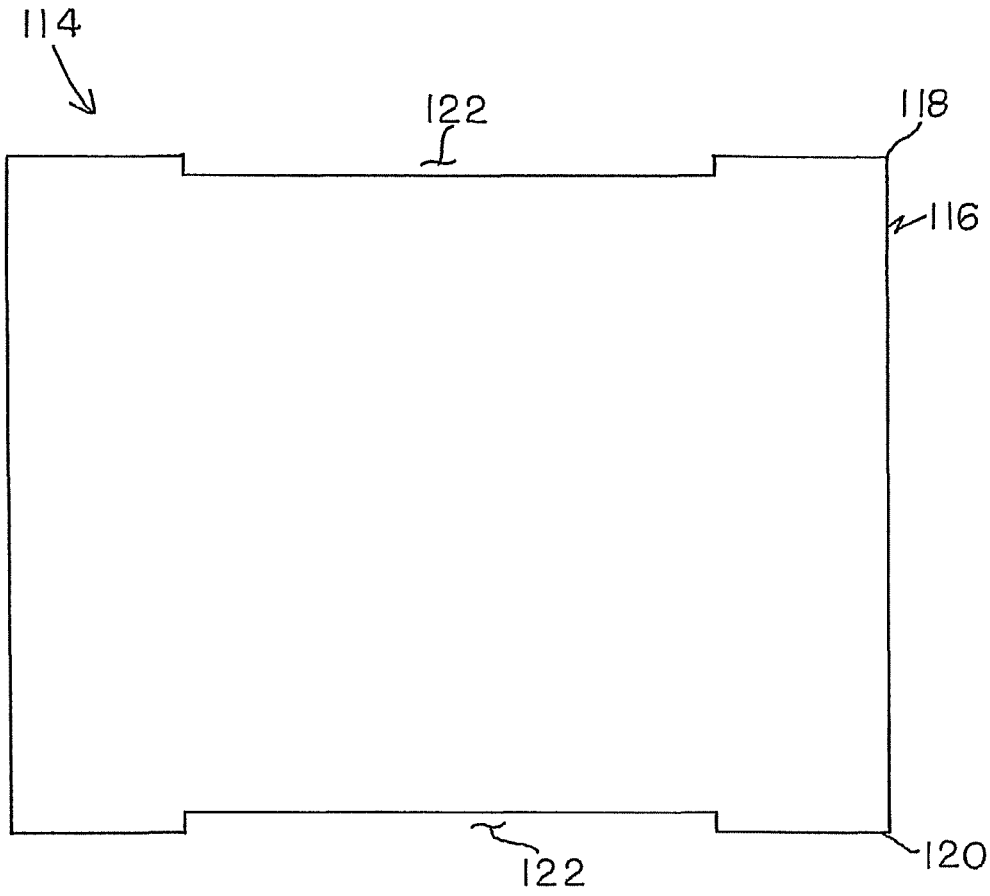
FIG. 16 is a top plan view of an insulated bottom plate for the tie plate assembly shown in FIG. 15.
Figure 17:
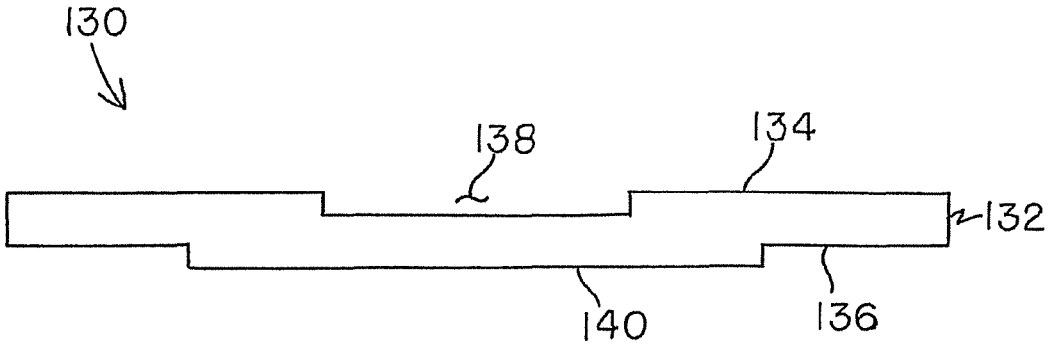
FIG. 17 is a side elevational view of an insulated side plate for the tie plate assembly shown in FIG. 15.

FIG. 15 shows a tie plate assembly 110 that includes tie plate 100 that is similar to tie plate assembly 50 except for the differences noted below. Like reference numerals are used for like elements. Instead of tie plate 52 (shown in FIG. 8) being made of an electrically-insulated material, tie plate 100 includes electrically-insulated material 112 covering the recess surface 102 and the sidewalls 94, 96 of the recessed area 54 for electrical isolation of railroad rail 56. Referring to FIGS. 15A, 16 and 17, the electrically-insulated material 112 includes an insulated bottom plate 114 adapted to cover the recess surface 102, and a pair of insulated side plates 130 adapted to cover the sidewalls 94, 96 of tie plate 100. The electrically-insulated material 112 used for the bottom plate 114 and the side plates 130 can be made of any insulating material that can withstand the high impact and high compression forces exerted thereon by a railcar. Such material may include, but not limited to, fiberglass, a high strength polymeric material and Kevlar®. The side plates 130 and the bottom plate 114 may be interlockingly secured to each other. The side plates 130 and the bottom plate 114 are preferably adhesively secured to the tie plate 100.

Figure 18:
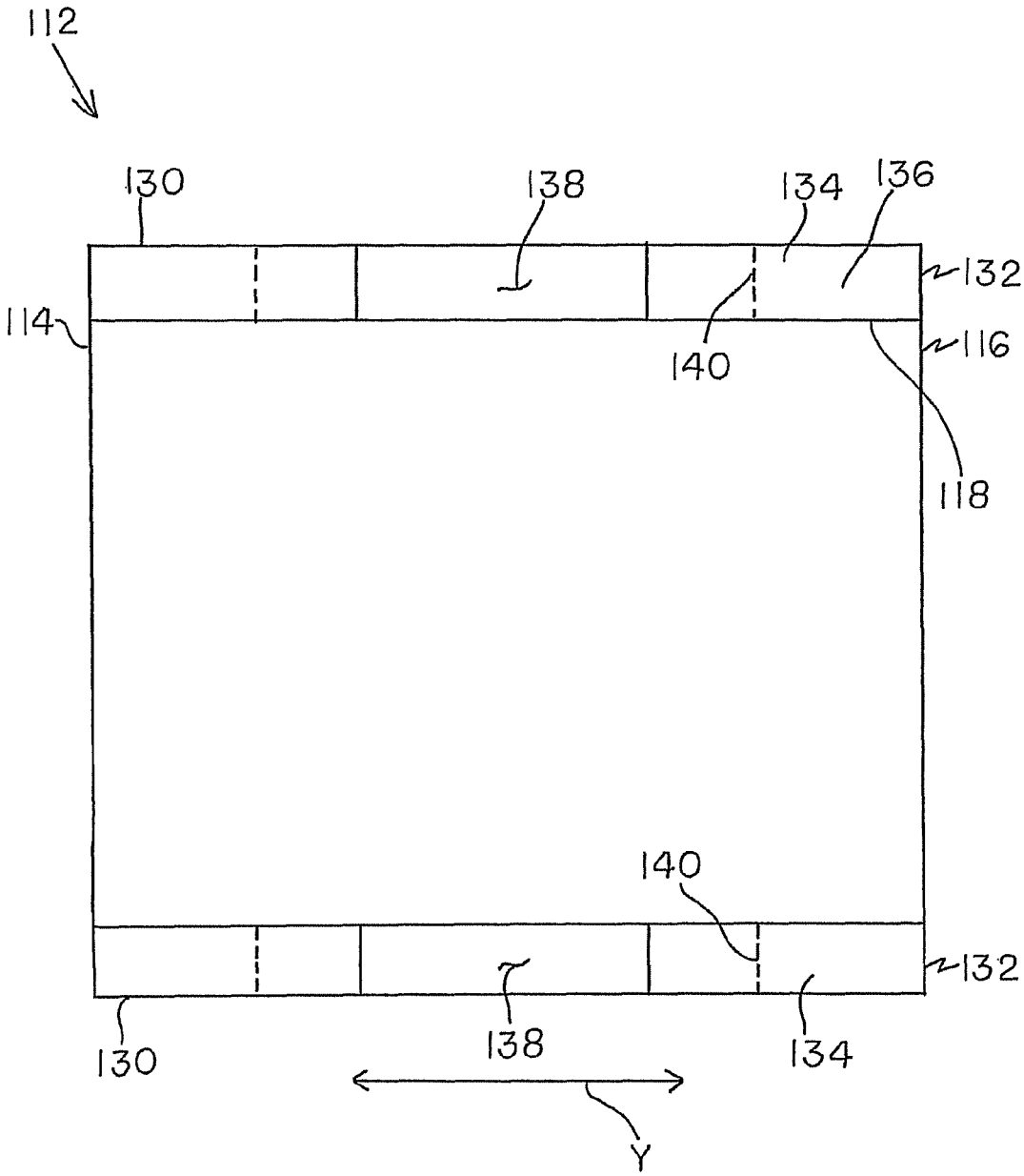
FIG. 18 is a top plan view of the insulated plates shown in FIGS. 16 and 17 assembled together.

Referring to FIG. 16, the bottom plate 114 includes a planar body 116 that is generally rectangular shaped and has a first side 118 and a second side 120, wherein each side 118, 120 defines a notch or groove 122 therein. Referring to FIG. 17, the side plate 130 includes a longitudinally extending body 132 having an upper surface 134 and a lower surface 136, wherein a recess or notch 138 is defined on the upper surface 134 and a protrusion 140 is defined on the lower surface 136. The side plate 130 is not drawn to scale with respect to the bottom plate 114 shown in FIGS. 16 and 17. FIG. 18 shows the side plates 130 attached to the bottom plate 114, wherein the protrusions 140 of the side plates 130 are inserted into the grooves 122 of the bottom plate 114 thus interlocking the side plates 130 to the bottom plate 114.

Referring back to FIGS. 15 and 15A, the tie plate assembly 110 also includes clips 62 which are inserted in the same manner as tie plate assembly 50 shown in FIG. 8. However, because of the shape of the insulated material 112, the first ledge 70 defined on the surface 66 of the clip 62, which is adapted to coact with the railroad rail 56, also contacts the upper surface 134 of the side plates 130, thus electrically insulating the tie plate 100 from the railroad rail 56. Also, tie plate 90 can also be used with tie plate assembly 110. A portion 150 of the clip 62 is received within the notch 138 so as to prevent or limit lateral movement of the clip 62 in the Y direction (shown in FIG. 18) relative to the railroad rail 56, tie plate 100 and rail joint 76.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A notched tie plate insulator for electrically insulating a tie plate, the tie plate having a recessed area adapted to receive a railroad rail, the insulator comprising:

a bottom plate having a first side and a second side and adapted to be received within the recessed area of the tie plate, wherein each side defines a notch therein; and a pair of side plates attached to said bottom plate, said side plate includes a longitudinal extending body having an upper surface and a lower surface and defining a recess on said upper surface and a protrusion on said lower surface, wherein said protrusion of each of said side plates is received within said notches of said bottom plate to interlock said side plates to said bottom plate, and wherein portions of said bottom surfaces of said side plates adjacent to said protrusions extend along the respective first and second sides of said bottom plate.

2. The notched tie plate insulator as claimed in claim 1, wherein said bottom plate and said side plate are made of an insulating material capable of withstanding the high impact and high compression forces exerted thereon by a railcar.

3. The notched tie plate insulator as claimed in claim 1, wherein said bottom plate and said side plate are made of fiberglass.

4. The notched tie plate insulator as claimed in claim 1, wherein said bottom plate and said side plate are made of a high strength polymeric material.

5. The notched tie plate insulator as claimed in claim 1, wherein said bottom plate and said side plates are interlockingly secured to each other.

6. A tie plate, comprising:

a base plate having a recessed area adapted to receive a railroad rail, the recessed area is defined by two spaced-apart sidewalls and a recess surface therebetween;

a separate layer of electrically-insulating material covering the side walls and the recess surface of the recessed area of the base plate, said layer of electrically-insulating material comprising a bottom plate and a pair of side plates attached to said bottom plate, said bottom plate having a first side and a second side, each side defining a notch therein, said side plate including a longitudinal extending body having an upper surface and a lower surface and defining a recess on said upper surface and a protrusion on said lower surface, wherein said protrusion of each of said side plates is received within said notches of said bottom plate to interlock said side plates to said bottom plate, and wherein portions of said bottom surfaces of said side plates adjacent to said protrusions extend along the respective first and second sides of said bottom plate; and a plurality of slots defined on said base plate, wherein said slots are adapted to receive fasteners for securing a railroad rail.

7. The tie plate as claimed in claim 6, wherein the recess surface of the base plate is planar.

8. The tie plate as claimed in claim 6, wherein the recess surface of the base plate is tapered.

9. The tie plate as claimed in claim 8, wherein said base plate further includes a ledge adjacent to one of said side walls.

10. A tie plate assembly for a railroad rail, comprising:

a tie plate having a recessed area adapted to receive a railroad rail;

a layer of electrically-insulating material covering the recessed area of said tie plate, said layer of electrically-insulating material comprising a bottom plate having a first side and a second side and adapted to be received within the recessed area of the tie plate, and a pair of side plates attached to said bottom plate, said side plates include a longitudinal extending body having an upper surface and a lower surface and defining a recess on said upper surface;

a plurality of slots defined on said tie plate;

a fastener passing through one of said slots for securing said tie plate to a rail tie; and an electrically-insulated clip secured to said tie plate via said fastener, said clip having a surface received by said recess on said upper surface of one of said pair of side plates such that lateral movement of said clip is limited when securing a railroad rail to said tie plate.

11. The tie plate assembly as claimed in claim 10, wherein said layer of electrically-insulating material is adhesively secured to said tie plate.

12. The tie plate assembly as claimed in claim 10, wherein said layer of electrically-insulating material comprises a bottom plate having a first side and a second side, wherein each side defines a notch therein, and a pair of side plates attached to said bottom plate, said side plate includes a longitudinal extending body having an upper surface and a lower surface and defining a recess on said upper surface and a protrusion on said lower surface, wherein said protrusion of each of said side plates is received within said notches of said bottom plate and, wherein said surface of said clip is received within the recess of said body of said side plate.

13. The tie plate assembly as claimed in claim 12, wherein the recessed area of said tie plate is defined by two spaced-apart sidewalls and a recess surface therebetween, wherein said bottom plate covers said recess surface and said side plates cover said side walls of the recessed area of said tie plate.

14. The tie plate assembly as claimed in claim 13, wherein said bottom plate and said side plates are interlockingly secured to each other.

15. The tie plate assembly as claimed in claim 13, wherein said recess surface of said tie plate is planar.

16. The tie plate assembly as claimed in claim 13, wherein the recess surface of said tie plate is tapered.

17. The tie plate assembly as claimed in claim 16, wherein said tie plate further includes a ledge adjacent one of said side walls, wherein a surface of said ledge is adapted to abut against a portion of said surface of said clip.

* * * * *